US005533345A

United States Patent [19]

Roth

[11] Patent Number: 5,533,345

[45] Date of Patent: Jul. 9, 1996

[54] REFRIGERANT RECOVERY SYSTEMS EMPLOYING SERIES/PARALLEL PUMPS

[75] Inventor: Robert J. Roth, La Crosse, Wis.

[73] Assignee: American Standard Inc., Piscataway, N.J.

[21] Appl. No.: 289,828

[22] Filed: Aug. 12, 1994

[51] Int. Cl.[6] ..... F25B 45/00

[52] U.S. Cl. ..... 62/77; 62/292; 62/DIG. 2

[58] Field of Search ..... 62/292, 149, 77, 62/85, 475, DIG. 2

[56] References Cited

U.S. PATENT DOCUMENTS

| | | | |
|---|---|---|---|
| 4,476,688 | 10/1984 | Goddard | 62/149 |
| 4,805,416 | 2/1989 | Manz et al. | 62/292 |
| 5,247,804 | 9/1993 | Paige et al. | 62/77 |
| 5,272,882 | 12/1993 | Degier et al. | 62/77 |

*Primary Examiner*—John M. Sollecito
*Attorney, Agent, or Firm*—William J. Beres; William O'Driscoll; Peter D. Ferguson

[57] ABSTRACT

A system for transferring a refrigerant from a first refrigerant vessel having at least one refrigerant port to a second refrigerant vessel having at least one refrigerant port is disclosed. This system includes a condenser, a pump assembly having an inlet and an outlet, and conduits for operatively connecting the condenser and pump assembly to the first and second refrigerant vessel in several configurations. The pump assembly includes two pumps operated by one motor and interconnected to either provide series or parallel pumping. This system may also include a transfer tank interposed between the first and second refrigerant vessels. The transfer tank can be used to condense the vapor phase of the refrigerant removed from the first refrigerant vessel and collect the condensed refrigerant in one configuration, then to transfer the condensed refrigerant to the second refrigerant vessel in an alternate configuration. Methods employing this apparatus for transferring a refrigerant between a first refrigerant vessel and a second refrigerant vessel, optionally via a separate transfer tank, are also disclosed.

11 Claims, 8 Drawing Sheets

REFRIGERANT RECOVERY SYSTEMS EMPLOYING SERIES/PARALLEL PUMPS

CROSS-REFERENCE TO RELATED APPLICATIONS

This application addresses subject matter related to that of U.S. Ser. No. 817,019, now U.S. Pat. No. 5,272,882, filed by the assignee of the present application on behalf of inventors Degier, Groth, Kerr, Mullally, Pruse, and Roth on Jan. 3, 1992, entitled "Portable Recycle/Recovery/Charging System." This document is hereby incorporated herein by reference in its entirety.

BACKGROUND OF THE INVENTION

The present invention is directed to a refrigerant transfer system. More specifically, the present invention is directed to a highly versatile yet portable system which can evacuate one refrigeration system or refrigerant vessel, repressurize the vapor component of the refrigerant, and transfer the refrigerant to another refrigerant system or vessel, particularly when a low pressure refrigeration system is involved.

Previous recycle/recovery systems have been meant for use with high pressure refrigeration systems such as those used in automobile air conditioning units. The previous systems are designed so that an untrained service person can service an automobile air conditioning unit by simply making a few hose connections and initiating an automatic process. Such a system is shown in U.S. Pat. No. 4,805,416 to Manz et al. This system is intended for operation by relatively unskilled personnel with minimum operator intervention. However, in each embodiments shown in FIGS. 1–8 of Manz et al., the required sequence of an inlet 32, a strainer 30, a pressure switch 42, a valve 28, 78, a heat exchange/oil separation unit 26, a compressor 22, the heat exchange/oil separation unit 26, a pressure switch 70 and a container 58 limit the versatility of this unit while contributing greatly to its expense.

A much better portable recovery system is disclosed in the system disclosed in Degier et al. as identified above, which is not admitted to be prior art. Degier et al. disclose a pump and a condenser connected in various configurations with the refrigerant head and sump of a chiller and a holding tank to transfer a refrigerant from one to the other. The system optionally includes filtering, dehydrating, and other auxiliary equipment as well as equipment for transferring the refrigerant. The components used to carry out these operations are desirably mounted on a cart or other fixed or portable platform so they can be transported and used together.

The present invention is a further improvement of the apparatus and methods disclosed by Degier et al.

Such apparatus would desirably have different pumps at different stages of the recovery of refrigerant from a chiller or other vessel. A high volume pump would be desirable for recovery of refrigerant who's vapor density is already high, thus requiring relatively less compression and thus minimizing the time required for a complete recovery. On the other hand, a high pressure pump would be desirable to draw a vacuum in the tank from which the refrigerant is transferred after its liquid contents have been exhausted and only refrigerant vapor remains. Conventional refrigerant recovery units are only equipped with a single pump which is a compromise between these different needs.

A refrigerant recovery unit or similar apparatus should provide a high recovery level of the refrigerant, consistent with ever-tightening government regulations and industry standards mandating stringent measures to prevent the release of noxious or environmentally undesirable refrigerant vapor into the atmosphere or into a work environment when a refrigeration unit is repaired, recharged, or decommissioned.

Refrigerant recovery apparatus is needed in which one component, such as a particular pump or the motor to drive it, can be adapted to different configurations instead of providing specialized components for each configuration. For example, a refrigerant recovery unit or similar apparatus would desirably use one motor to drive both a high-volume pump and a high-pressure pump.

A refrigerant recovery unit is desirably both versatile and easily used by a trained operator.

SUMMARY OF THE INVENTION

One object of the invention is to provide a refrigerant recovery unit or similar apparatus which combines the advantages of having a high volume pump and a high pressure pump.

Another object of the invention is to provide a refrigerant recovery unit or similar apparatus which recovers a greater proportion of the refrigerant than other units presently available.

An additional object of the invention is to provide a refrigerant recovery unit or similar apparatus in which one motor may be used to drive both a high-volume pump and a high-pressure pump.

Another object of the invention is to provide automatic controls which monitor the pressure of compressor inlet, pressure of condenser and liquid level in the transfer tank in order to select the appropriate configuration of the system.

A further object of the invention is to provide a refrigerant recovery unit or similar apparatus which has a nearly constant horsepower requirement at the different stages of a refrigerant transfer operation.

Still another object of the invention is to provide a refrigerant recovery unit which is well-adapted to be configured in the several necessary ways by making hose connection changes, by providing permanent conduits and a series of electronically controlled configuration valves, or by a combination of these expedients.

One or more of the preceding objects, or one or more other objects which will become plain upon consideration of the present specification, are satisfied by the invention described herein.

One aspect of the invention, which satisfies one or more of the above objects, is a system for transferring a refrigerant from a first refrigerant vessel having at least one refrigerant port to a second refrigerant vessel having at least one refrigerant port. This system includes (but is not limited to) a condenser having an inlet and an outlet, a pump assembly having an inlet and an outlet, and conduits for operatively connecting the condenser and pump assembly to the first and second refrigerant vessel in several configurations.

The pump assembly includes a first pump having a first inlet and a first outlet and a second pump having a second inlet and a second outlet. At least one of the pump inlets defines an inlet of the pump assembly, and at least one of the pump outlets defines an outlet of said pump assembly.

Some of the conduits operatively connect the pump assembly inlet and outlet with at least two of a refrigerant port of a first refrigerant vessel, a refrigerant port of a second refrigerant vessel, and the inlet of the condenser. Other conduits interconnect the first and second pump inlets and outlets to selectively establish either parallel or series operation of the pumps as an assembly. Parallel pump operation is arranged by establishing communication between the first and second pump inlets and by establishing independent communication between the first and second pump outlets. Series pump operation is arranged by establishing communication between the first pump outlet and the second pump inlet.

Another aspect of the invention is a system for transferring a refrigerant from a first refrigerant vessel having at least one refrigerant port to a second refrigerant vessel having at least one refrigerant port. This system includes (but is not limited to) a condenser having an inlet and an outlet; a pump having an inlet and an outlet; a transfer tank having at least two refrigerant ports; and a series of conduits. The conduits connect the pump inlet and outlet to at least two of a refrigerant port of a first refrigerant vessel, a refrigerant port of a second refrigerant vessel, the inlet of the condenser, and the outlet of the condenser. The transfer tank is connected in series with at least one of these conduits.

Yet another aspect of the invention is a method for transferring a refrigerant between a first refrigerant vessel having at least one refrigerant port and a second refrigerant vessel having at least one refrigerant port. The method is begun by providing a condenser having an inlet and an outlet; a pump having an inlet and an outlet; and a transfer tank having a fluid port and a vapor port. The elements are connected in a series in this order: a refrigerant port of a first refrigerant vessel, a fluid port of the transfer tank, the vapor port of the transfer tank, an inlet of the pump, an outlet of the pump, the inlet of the condenser, the outlet of the condenser, and a refrigerant port of a second refrigerant vessel. Then the pump is operated to transfer a refrigerant between the first refrigerant vessel and the second refrigerant vessel. The method is not limited to these steps, however.

Still another object of the invention is to provide a means to detect whether incoming refrigerant is liquid or vapor. By detecting the state of incoming refrigerant, appropriate processing can be selected which both speeds processing and protects the compressor from damage caused by intake of refrigerant liquid.

And another object of this invention is to provide process controls and means to limit pressure in the second refrigerant vessel due to incomplete cooling and/or the accumulation of non-condensables in the system. This improves speed of the recovery process and reduces refrigerant contamination caused by non-condensables.

Still another aspect of the invention is a method for transferring a refrigerant between a first refrigerant vessel and a transfer tank. This method includes (but is not limited to) the following steps.

A condenser, two pumps, a first refrigerant vessel, a transfer tank, and a valve are provided. The first refrigerant vessel has at least one refrigerant port. The transfer tank has at least two fluid ports and one vapor port. The condenser has an inlet and an outlet. The first pump has a first inlet and a first outlet and is operable to produce a first pressure difference. The second pump has a second inlet and a second outlet and is operable to produce a second pressure difference. The valve has an inlet and an outlet and is adapted to allow a fluid to flow from the inlet to the outlet when the pressure at the valve inlet exceeds the pressure at the valve outlet by more than a predetermined amount which is not greater than the second pressure difference.

The elements are connected in a series in this order: the refrigerant port of the first refrigerant vessel, the first inlet, the first outlet, a first fluid port of the transfer tank, the vapor port of the transfer tank, the second inlet, the second outlet, the inlet of the condenser, the outlet of the condenser, the inlet of the valve, the outlet of the valve, and a second fluid port of the transfer tank.

The first and second pumps are then operated to transfer a refrigerant between the first refrigerant vessel and the transfer tank while condensing refrigerant vapor within the transfer tank.

Figure 1:
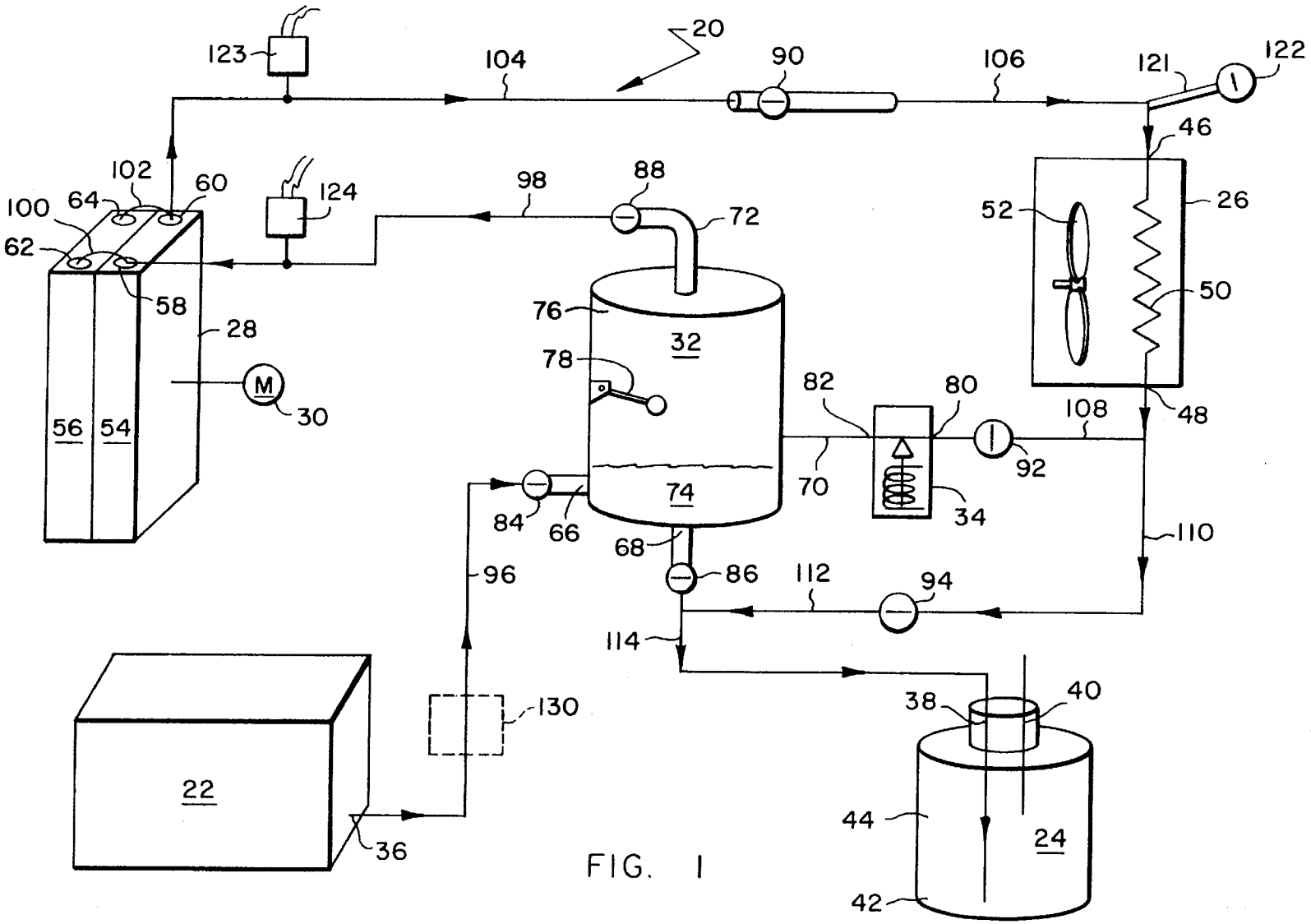
FIG. 1 is a schematic view of a refrigerant recovery unit according to the present invention, interconnecting the refrigerant vessel of a refrigeration system and a storage vessel in one mode of operation.

The reference characters used in the Figures are assigned as follows:

| | |
|---|---|
| 20 | refrigerant transfer system |
| 22 | first vessel |
| 24 | second vessel |
| 26 | condenser |
| 28 | pump assembly |
| 30 | motor |
| 32 | transfer tank |
| 34 | expansion valve |
| 36 | refrigerant port (of 22) |
| 38 | refrigerant fluid port (of 24) |
| 40 | refrigerant vapor port (of 24) |
| 42 | liquid refrigerant (of 24) |
| 44 | headspace (of 24) |
| 46 | inlet (of 26) |
| 48 | outlet (of 26) |
| 50 | coil (of 26) |
| 52 | cooling fan (of 26) |
| 54 | first pump (of 28) |
| 56 | second pump (of 28) |
| 58 | inlet (of 54) |
| 60 | outlet (of 54) |
| 62 | inlet (of 56) |
| 64 | outlet (of 56) |
| 66 | fluid port (of 32) |
| 68 | fluid port (of 32) |
| 70 | fluid port (of 32) |
| 72 | vapor port (of 32) |
| 74 | liquid refrigerant (in 32) |
| 76 | headspace (in 32) |
| 78 | float switch (of 32) |
| 80 | inlet (of 34) |
| 82 | outlet (of 34) |
| 84 | valve |
| 86 | valve |
| 88 | valve |
| 90 | valve |
| 92 | valve |
| 94 | valve |
| 96 | conduit |

-continued

| | |
|---|---|
| 98 | conduit |
| 100 | conduit |
| 102 | conduit |
| 104 | conduit |
| 106 | conduit |
| 108 | conduit |
| 110 | conduit |
| 112 | conduit |
| 114 | conduit |
| 118 | conduit |
| 120 | conduit |
| 121 | conduit |
| 122 | purge valve |
| 123 | discharge pressure sensor |
| 124 | inlet pressure sensor |
| 125 | pressure sensor |
| 130 | supplemental pump |

Like reference characters are assigned to corresponding parts of the several embodiments of the invention.

DETAILED DESCRIPTION OF THE INVENTION

While the invention will be described in connection with one or more preferred embodiments, it will be understood that the invention is not limited to those embodiments. On the contrary, the invention includes all alternatives, modifications, and equivalents as may be included within the spirit and scope of the appended claims.

Apparatus

Referring first to FIG. 1, the refrigerant transfer system 20 generally comprises a first refrigerant vessel 22, a second refrigerant vessel 24, a condenser 26, a pump assembly 28, a motor 30 for operating the pump assembly 28, a transfer tank 32, and an expansion valve 34.

The first refrigerant vessel 22 can be a heating, ventilating, and air conditioning unit or other apparatus which uses a refrigerant fluid to operate, particularly a volatile fluorochlorocarbon refrigerant such as the materials sold under the trademark FREON. (FREON is a registered trademark of E. I. Du Pont de Nemours & Co., Wilmington, Del.) The first refrigerant vessel 22 can also be a refrigerant storage tank.

The vessel 22 is equipped to receive or to drain a refrigerant as the need arises. In this embodiment, the vessel 22 has a single port 36 which functions as both the refrigerant inlet and the refrigerant outlet. (A "port" as defined in this specification is an opening which can function as an inlet, an outlet, or both.).

The elevation of the port for passing the gaseous or vapor phase of the refrigerant is not critical, so the same port 36 can function as both a liquid and as a vapor port. (In this specification, a "fluid port" or simply a "port" is one which passes liquids or gases, while a "vapor port" is a port positioned at the headspace of a vessel to selectively pass a gas or vapor.)

In this embodiment, the second refrigerant vessel 24 has a fluid port 38 and a vapor port 40. The fluid port 38 extends substantially to the bottom of the vessel 24, and thus can be used to receive or drain the liquid refrigerant 42 and receive a gaseous refrigerant. In the absence of sufficient liquid refrigerant 42 to reach the port 38, that same port 38 can be used to drain the vapor in the headspace 44 of the vessel 24. The vapor port 40 communicates with the headspace 44 within the vessel 24. Conventionally in such an arrangement, the vapor port 40 is positioned to receive a fluid at or near the top of the vessel 24, and is not used to drain a liquid.

The condenser 26 has an inlet 46, an outlet 48, a condensing coil 50, and cooling apparatus represented schematically by the cooling fan 52. The condenser operates conventionally to condense a refrigerant vapor, forming a refrigerant liquid. It is desirable to condense as much of the refrigerant vapor as possible whenever storing it so the refrigerant can be stored in a minimum of space and at a minimal pressure. The cooling fan 52, essentially an air-to-refrigerant heat exchanger, can be replaced by a water-to-refrigerant heat exchanger or by a refrigerant-to-refrigerant heat exchanger if desired.

The pump assembly 28 includes a first pump 54 and a second pump 56, which can each be driven by a single motor 30, as in the illustrated embodiment, or by separate motors. The first pump 54 has an inlet 58 and an outlet 60, while the second pump 56 has an inlet 62 and an outlet 64. The pumps 54 and 56 are adapted to primarily pump refrigerant vapor.

The transfer tank 32 can be large enough to contain the entire charge of refrigerant fluid from the first vessel 22. Alternatively, the transfer vessel can be smaller than the entire refrigerant charge, and can be emptied as it fills to remove the entire refrigerant charge from the first vessel 22. Even if all or a significant part of the refrigerant is to be transferred to a second refrigerant vessel 24, the transfer vessel 32 can be quite small, which is desirable if the apparatus is to be portable.

The transfer tank 32 has fluid ports 66, 68, and 70 and a vapor port 72. The fluid ports are preferably located at the bottom of the vessel 32, where any liquid refrigerant 74 accumulates. The vapor port 72 is located near the top of the tank 32, and communicate with the headspace 76 of the tank 32. A float switch 78 is provided. The switch 78 functions as described below to prevent the level of the refrigerant liquid 74 from exceeding a predetermined height in the tank 32. This expedient prevents the level of the liquid 74 from rising so high as to reach the vapor port 72 at any time when the apparatus is used.

The temperature regulated expansion valve 34 has an inlet 80 and an outlet 82. The valve 34 opens to pass fluid when the temperature at the valve discharge 82 exceeds the valve temperature setpoint by more than a predetermined amount. The valve creates back pressure to permit the refrigerant to condense in the coil 50 of the condenser 26, while passing liquid refrigerant from the higher pressure region upstream of the inlet 80 to the lower pressure region downstream of the outlet 82.

As is subsequently described, the system configuration and the pump configuration are either automatically or manually selected through monitoring of the inlet pressure and the discharge pressure of the pump assembly 28 as respectively measured by an inlet pressure sensor 124 and a discharge pressure sensor 123. The pumps 54, 56 are configured based upon the ratio of absolute pressure between the inlet and the discharge pressures. If the ratio is low, the pumps will be operated in parallel. If the ratio is high, the pumps will be operated in series. The discharge pressure is also used to select appropriate system configurations to optimize the system based upon the varying requirements caused by ambient temperature and/or the presence of non-condensables. The inlet pressure is used to terminate the recovery of refrigerant when pressure drops below set limits. The inlet pressure is also used to ensure the evacuation of the system at the end of the recovery cycle.

The apparatus shown in FIG. 1 also includes several valves and several conduits. The valves are numbered 84, 86, 88, 90, 92, 94 and 122. In the configuration of FIG. 1, the valves 84, 88, 90 and 94 are open, and the valves 86, 92, and 122 are closed. In this embodiment, the conduits 96, 98, 100, 102, and 104 can be hoses which are connected into the system by a quick-release or other coupling on at least one end so each conduit can be connected to different parts of the apparatus at different stages while evacuating or refilling a refrigerant vessel.

In this embodiment, the conduits 106, 108, 110, 112, 114 and 121 can be rigid pipes or hoses, and do not require releasable couplings because the connections made by these conduits can remain unbroken in all phases of removing and recharging a refrigerant from and to the first vessel 22. If any of the refrigerant handling apparatus of the present invention are to be uncoupled when the present apparatus is not in use, such as the first vessel 22 and optionally the second vessel 24, those parts can be joined to the remainder of the system 20 by releasable connections.

In an alternate embodiment of the invention described later, all the conduits 98 through 121 (and, if desired, the conduit 96) can form permanent connections. In that embodiment, configuration valves are shifted, preferably by an electronic control system, to change the effective conduit connections, and the need for hose connection changes during the process is obviated.

Method

The configuration of FIG. 1 is conveniently the first configuration employed in the process of removing the refrigerant from the first vessel 22. The configuration of FIG. 1 operates as follows.

The refrigerant first removed from the vessel 22 is usually predominantly in liquid form, unless the vessel 22 has so little of its original refrigerant charge within it that all the remaining refrigerant is in vapor form. The liquid refrigerant and any entrained gaseous refrigerant is removed through the conduit 96, the open valve 84, and the port 66 to the transfer tank 32. The liquid refrigerant, identified by the reference character 74, collects in the transfer tank 32. Any gaseous refrigerant entrained in the liquid refrigerant or formed in the system up to the transfer tank 32 accumulates in the headspace 76.

To draw the refrigerant into the tank 32, the vapor port 72 is connected through the open valve 88 and the conduit 98 to the inlet 58 of the first pump 54. The inlets 58 and 62 of the respective pumps communicate, so the pumps operate in parallel to quickly evacuate refrigerant vapor from the headspace 76 and draw the liquid refrigerant from the port 36 to add to the liquid refrigerant 74.

The refrigerant vapor withdrawn from the headspace 76 is forwarded by the pumps 54 and 56, via their communicating outlets 60 and 64, the conduit 104, the open valve 90, and the conduit 106, to the inlet 46 of the condenser 26. The condenser 26 condenses the refrigerant vapor to liquid form. The condensed refrigerant passes via the condenser outlet 48, the conduit 110, the open valve 94, the conduits 112 and 114, and the port 38 and is added to the accumulation of the liquid refrigerant, identified by the reference character 42, in the second refrigerant vessel 24.

The net result of operating in the configuration of FIG. 1 is that the liquid refrigerant from the first vessel 22 accumulates in the reservoir 74, while the gaseous refrigerant in the headspace 76 is condensed and accumulates in the reservoir 42.

After most of the liquid refrigerant has been removed from the vessel 22, it is useful to increase the head of pressure produced by the pump assembly 28 to produce a partial vacuum within the vessel 22 and thus remove as much of the refrigerant vapor as possible from the vessel 22. This change is effected by converting the pump assembly from the parallel arrangement shown in FIG. 1 to the series arrangement of FIG. 2. In the series configuration, the pressure difference produced by each pump is added to provide a greater net pressure difference. The volumetric pumping rate is that of the pump 54 or 56 having the smaller capacity, and thus much lower than the pumping rate of the parallel configuration. In either case, the total load on the motor 30 is comparable, notwithstanding the large differences in capacity and pressure increase between the respective configurations.

Figure 2:
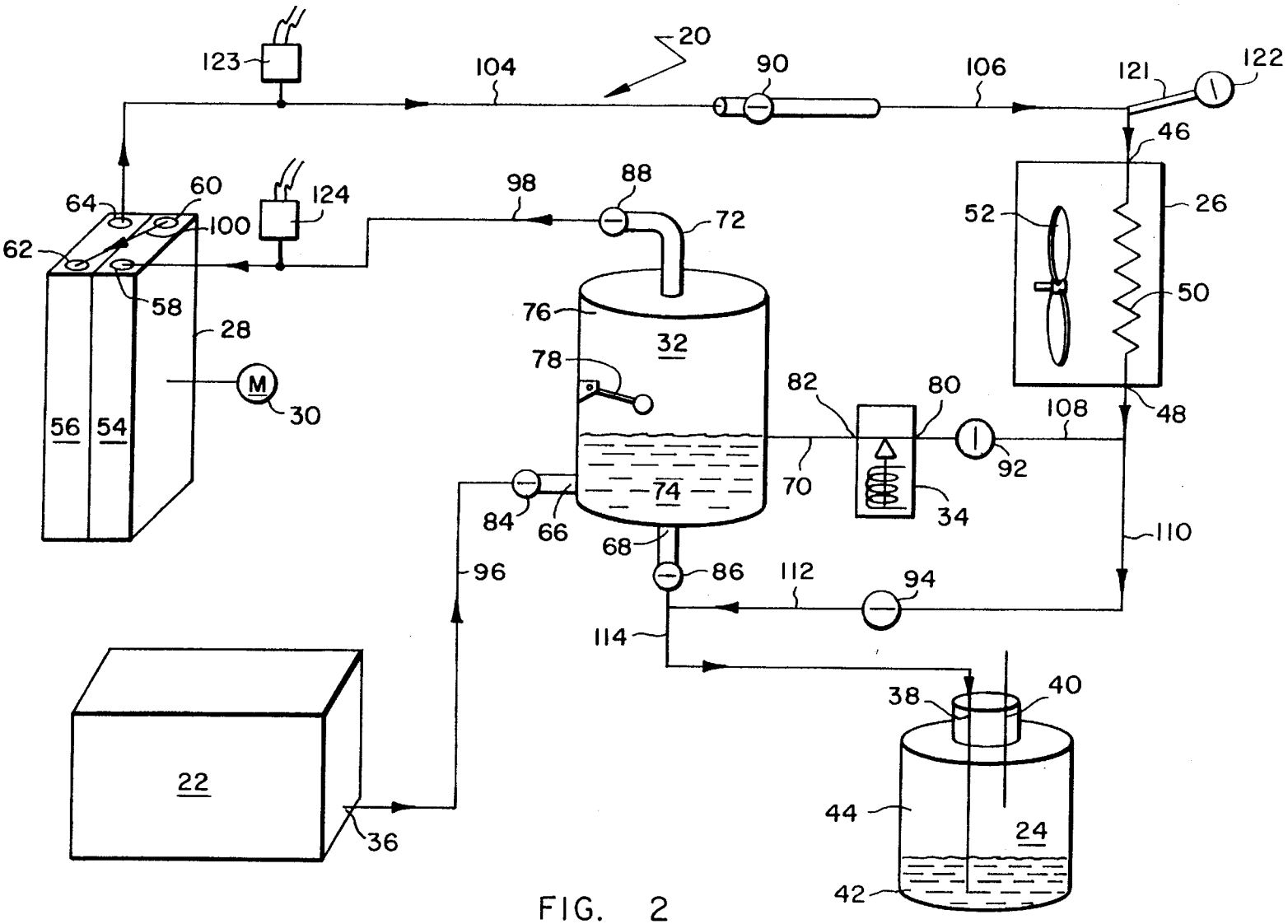
FIG. 2 is a view similar to FIG. 1, showing a second mode of operation of the system.

The system 20 is converted from the configuration of FIG. 1 to that of FIG. 2 by removing the conduit 102 and shifting one end of the conduit 100 from communication with the inlet 58 to communication with the outlet 60. The conversion is made when the pressure difference between the discharge pressure sensor 123 and the inlet pressure sensor 124 begins to increase.

Figure 3:
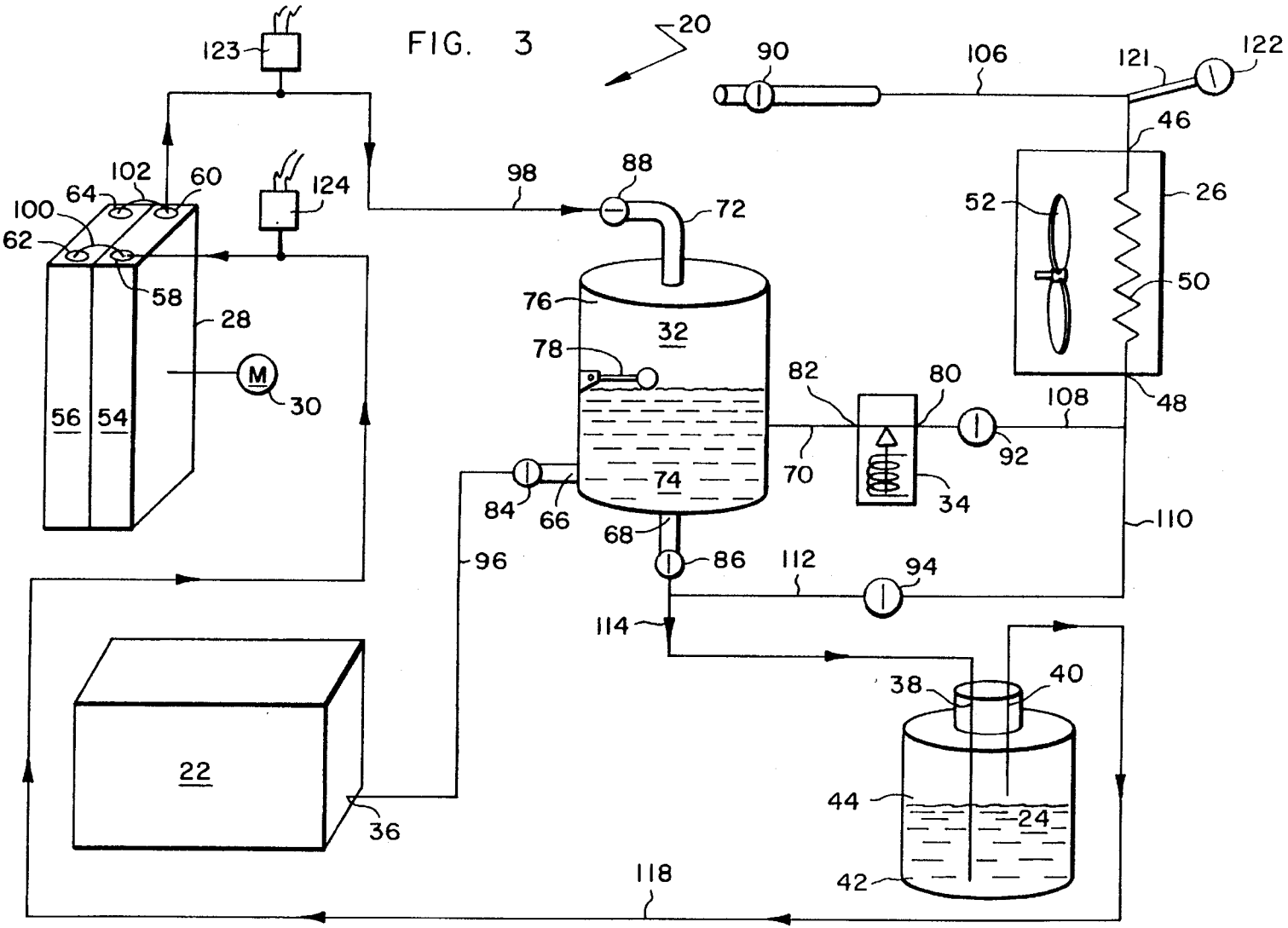
FIGS. 3 and 3A are views similar to FIG. 1, showing a third mode of operation of the system.
Figure 3A:
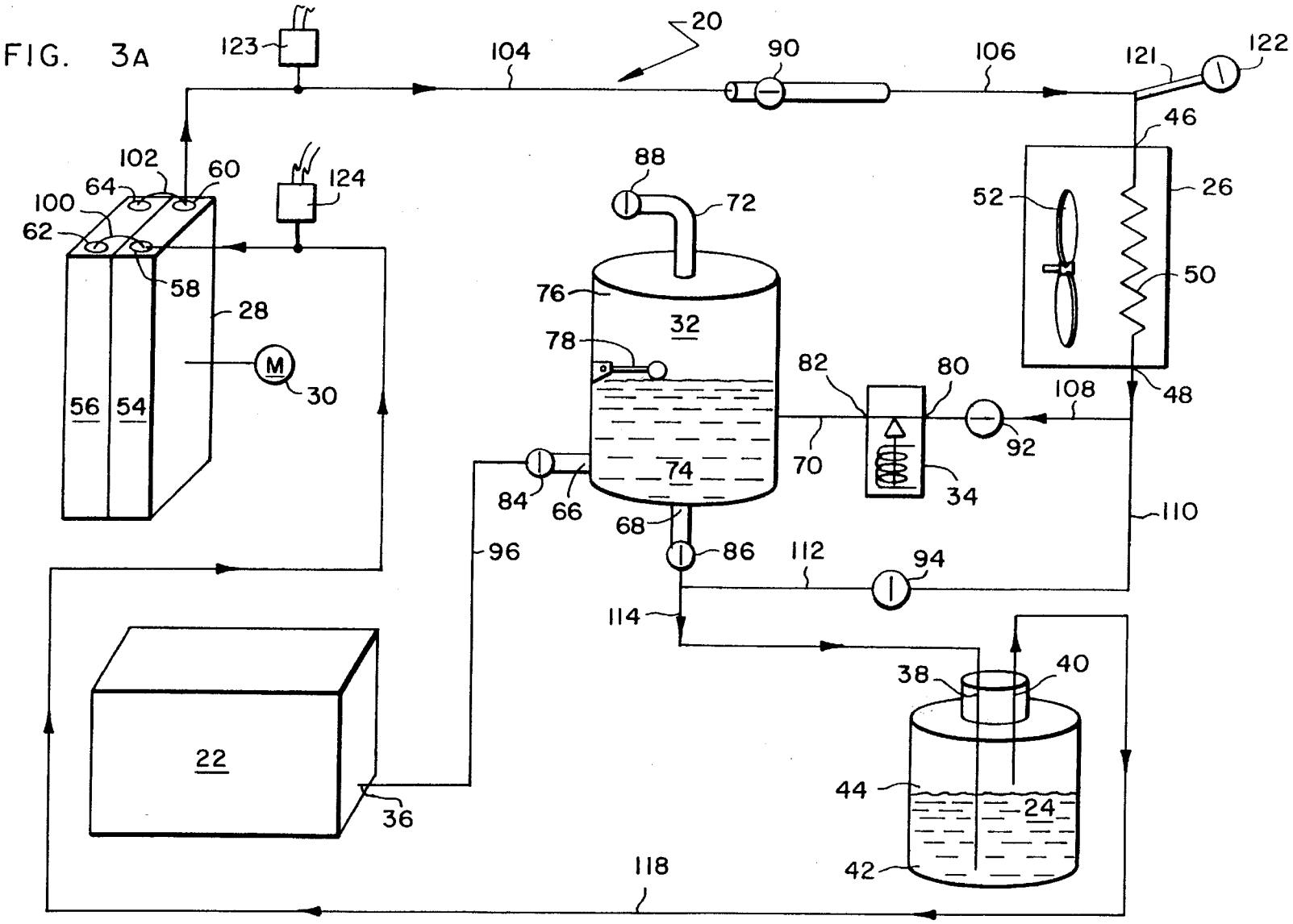

Either of the configurations of FIGS. 3 and 3A are used to empty the transfer tank 32 whenever the tank 32 has reached its capacity. In the configuration of FIG. 3, the reservoir of liquid refrigerant 74 in the transfer tank 32 is drained into the second refrigerant vessel 24, while refrigerant vapor is pumped from the headspace 44 to the headspace 76. This operation can be expedited by returning the pump assembly 28 to the parallel pump configuration of FIG. 1, since no pressure differential builds up between the headspaces 44 and 76 as this configuration operates.

To re-configure the system 20 as shown in FIG. 3, the valves 84, 90, and 94 are closed and the valve 86 is opened. The valve 88 is closed temporarily, the conduit 98 is disconnected from the pump inlet 58 and connected to the pump outlet 60, and the conduit 104 can be removed altogether. After the conduit 98 is changed, the valve 88 is reopened. A conduit 118 is connected between the port 40 (which communicates with the headspace 44) and the pump inlet 58.

The system of FIG. 3 operates as follows. Vapor from the headspace 44 is pumped, via the port 40 and conduit 118, by the parallel pump assembly 28. The vapor continues through the conduit 98 and into the vapor port 72 and headspace 76. The tendency for the pressure to increase in the headspace 76, relative to the headspace 44, urges the fluid 74 through the port 68, the open valve 86, and the conduit 114 to the port 38. The liquid refrigerant 74 in the transfer tank 32 is thus added to the liquid refrigerant 42 in the second refrigerant vessel 24.

The configuration of FIG. 3A duplicates the configuration of FIG. 3, but the conduit 98 is removed instead of the conduit 104. Valve 88 is temporarily closed while conduit 104 is moved from pump outlet 64 to pump outlet 60. Valves 90 and 92 are then opened. In FIG. 3A, the reservoir of liquid refrigerant 74 in the transfer tank 32 is drained into the second refrigerant vessel 24, while the refrigerant vapor and liquid pressurize the tank through the expansion device 34. Vapor from the headspace 44 is pumped, via the port 40 and conduit 118, by either single or parallel arrangement of the pumps 54, 56. The vapor continues through conduit 90 and condenser 26 and expansion device 34 into the tank 32. The expansion device 31 will offer relatively little restriction in this configuration due to the low pressure differential developed between the high and the low side of the system. As a result, the flowing liquid and gas refrigerant entering the tank 32 will urge the liquid refrigerant in the reservoir 74 through the port 68, the open valve 86 and the conduit 114 to the port 38.

If the tank 32 is small enough to be filled more than once in the course of draining the first vessel 22, then the system 20 can be alternately operated in the configurations of FIGS. 1 and 3 (or 3A) to alternately fill and drain the tank 32. The configuration of FIG. 2 is then used to complete the evacuation of the first vessel 22 by drawing a vacuum in the latter vessel.

Figure 4:
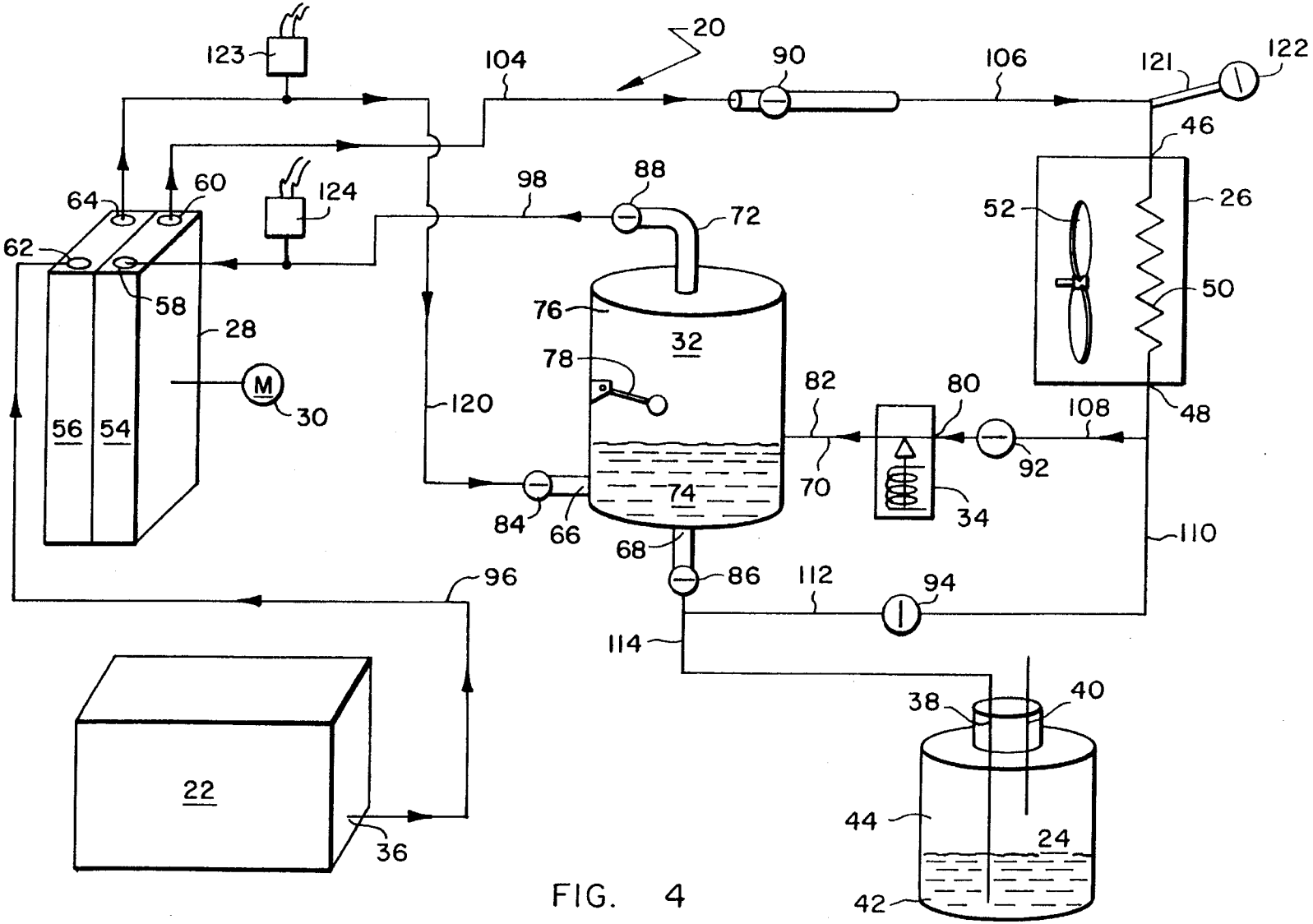
FIG. 4 is a view similar to FIG. 1, showing a fourth mode of operation of the system.

Turning now to FIG. 4, this configuration is used to condense refrigerant vapor in the first vessel 22 and in the headspace 76, adding the condensed liquid refrigerant to the liquid refrigerant 74 in the transfer tank 32. This configuration is initiated when pressure is high as measured at discharge pressure sensor 123 and is useful particularly when the level of vacuum drawn in the first vessel 22 is still relatively low, but only refrigerant vapor is being drawn from the vessel 22.

The configuration of FIG. 4 is established by uncoupling the inlets and outlets of the pumps 54 and 56. The pump 56 is used to pump refrigerant vapor from the port 36 to the port 66 via the conduit 96, the conduit 120, and the open valve 84. This transferred vapor collects in the headspace 76. At the same time, the pump 54 is used to pump refrigerant vapor from the headspace 76, via the vapor port 72, the open valve 88, the conduit 98, the conduit 104, and the open valve 90, to the inlet 46 of the condenser 26. The vapor is condensed in the coil 50, then the resulting liquid is expelled through the open valve 92 and the expansion valve 34 (which maintains adequate pressure in the condenser coil 50 to effect condensation) and back into the port 70, collecting with the liquid 74 in the tank 32. As a result of this step, the refrigerant vapor from the vessel 22 and the tank 32 is condensed and collected in the tank 32.

The configuration of FIG. 4 can also be alternated with the configurations of FIGS. 3 or 3A to alternately fill and empty the transfer tank 32.

Figure 5:
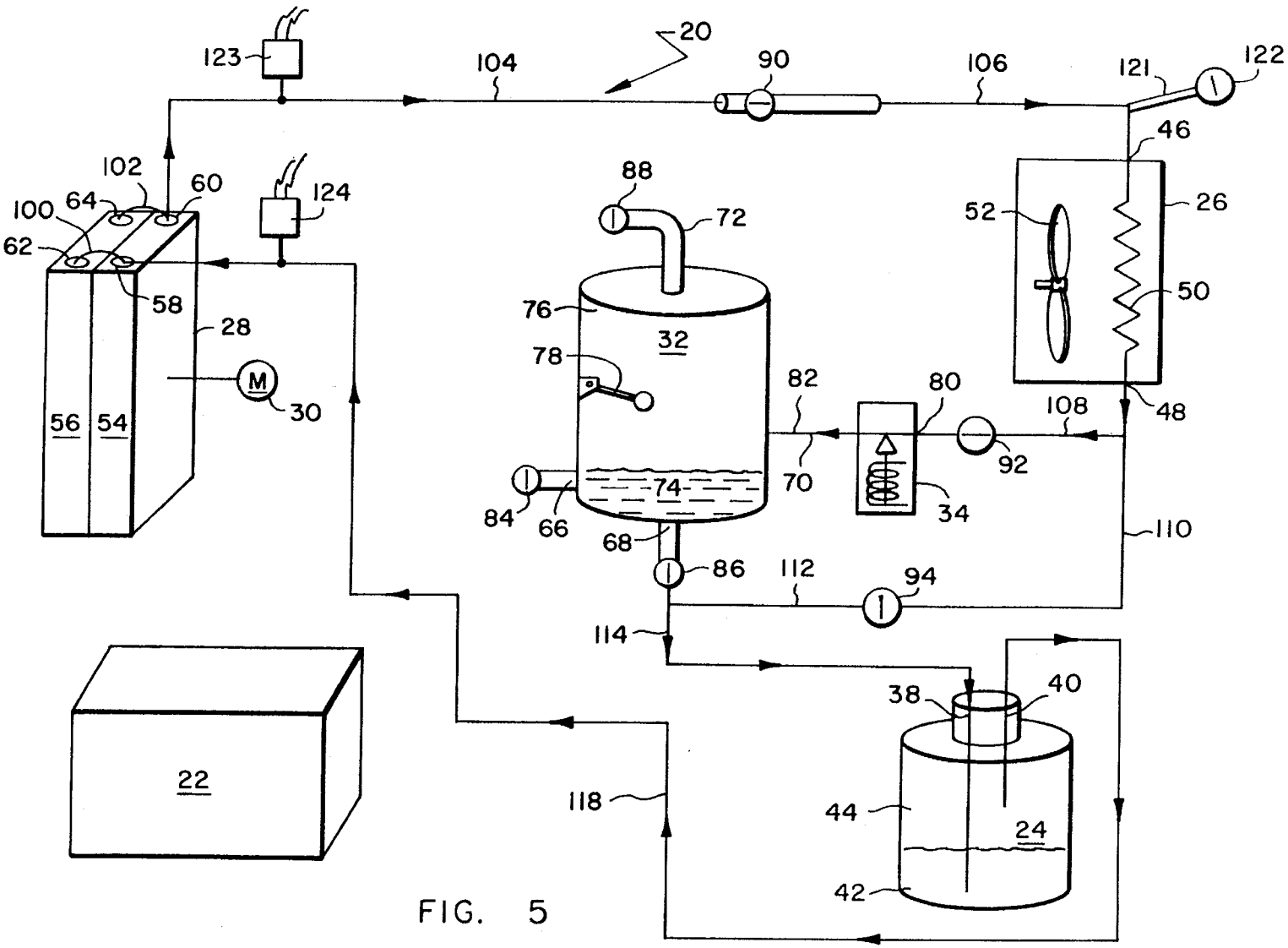
FIG. 5 is a view similar to FIG. 1, showing a fifth mode of operation of the system.

FIG. 5 is similar to the configuration described in 3A. In this case, the configuration of FIG. 5 is used if the unacceptably high pressure which triggers the configuration of FIG. 4 is unabated by operation in the configuration of FIG. 4. The configuration of FIG. 5 is also used to clear the recovery system of any recovered liquid and to cool the tank 24 after all vapor has been recovered from the vessel 22.

FIG. 5 shows the first vessel 22 completely disconnected from the system 20 after being exhausted of its charge of refrigerant. The configuration of FIG. 5 converts the refrigerant vapor in the headspace 44 to a liquid and returns the liquid to the second refrigerant vessel 24. The configuration of FIG. 5 is arranged by closing the valve 84 and removing the conduit 96 from the configuration shown in FIG. 3A.

In the configuration of FIG. 5, the refrigerant vapor in the headspace 44 is drawn through the port 40 and the conduit 118 by the pump 28, which is in its parallel pumps configuration. The vapor then passes through the conduit 104, the open valve 90, and the conduit 106 to the condenser 26, where it is condensed into liquid form. The condensed refrigerant passes via the open valve 92 and the expansion valve 34 into the port 70 to join the body 74 of liquid refrigerant. The liquid refrigerant 74 drains via the port 68, the valve 86, and the conduit 114 to the port 38, and from there into the accumulated liquid refrigerant 42. The reduced pressure of the headspace 44 caused by pumping refrigerant vapor from that headspace tends to draw the liquid refrigerant 74 into the second refrigerant vessel 24.

Figure 7:
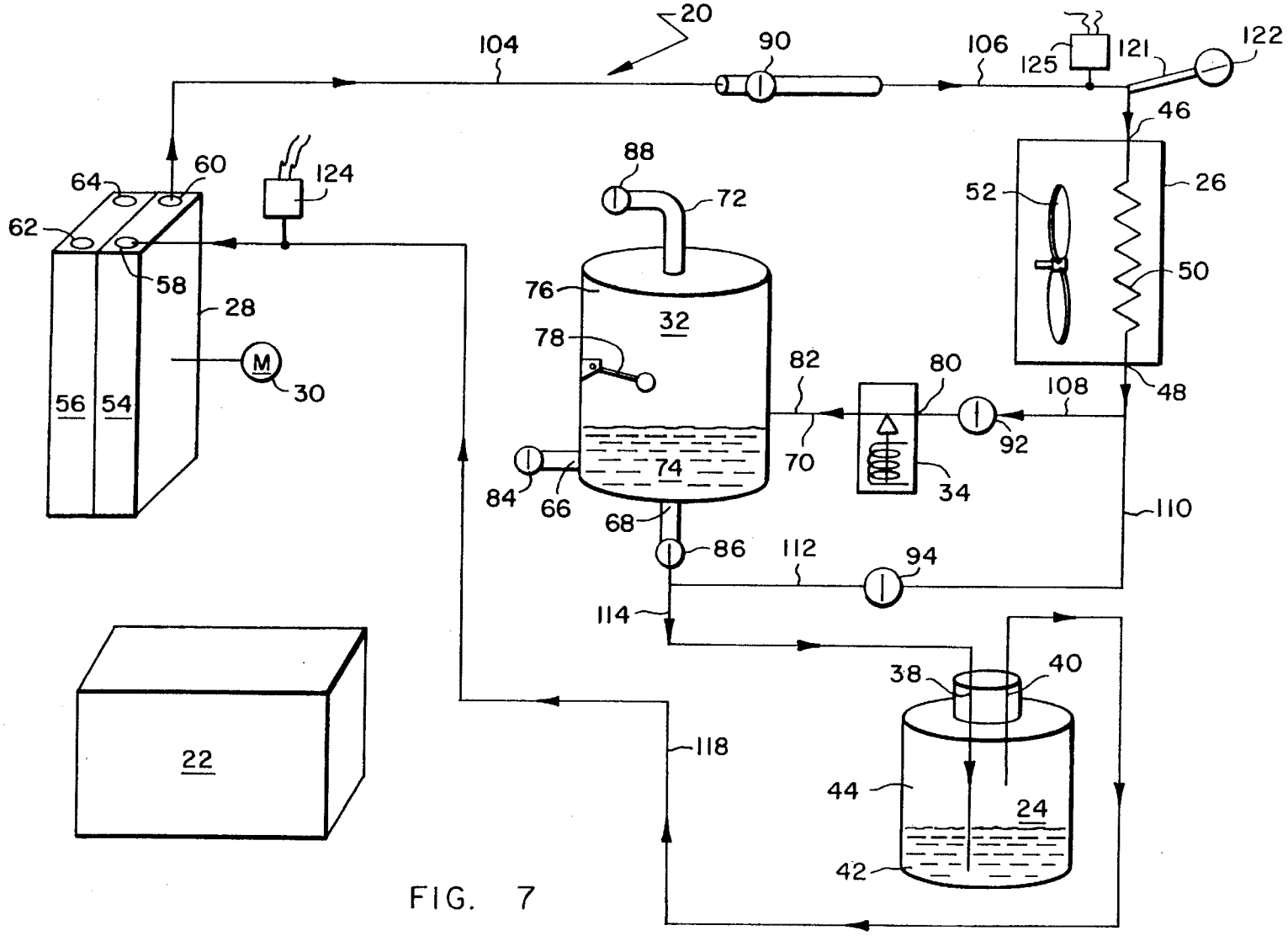
FIG. 7 is a view similar to FIG. 1 showing a seventh mode of operation of the system.

If non-condensables have accumulated in the system, use of the configuration of FIG. 5 will not reduce the high pressure as sensed at discharge pressure sensor 123. Thus, when the pressure does not reduce after use of the configuration of FIG. 5, the system will be reconfigured, in mid-process, into the configuration of FIG. 7. In the configuration of FIG. 7, the conduits 100 and 102 are removed. The refrigerant vapor in the headspace 44 is drawn through the port 40 and the conduit 118 by the pump assembly 28 which may be in single, parallel, or series depending upon capacity of the compressor. Vapor then passes through conduit 104, the open valve 90, and the conduit 106 to the condenser 26, where it is condensed into liquid form. The condensed refrigerant passes via open valve 92 and the expansion valve 34 into the port 70 to join the body of 74 liquid refrigerant. The liquid refrigerant 74 drains via the port 68, the valve 86, and the conduit 114 to the port 38, and from there to the accumulated liquid refrigerant 42. The reduced pressure of the headspace 44 caused by pumping refrigerant vapor from that headspace tends to draw the liquid refrigerant 74 into the second refrigerant vessel 24. Any non-condensables located in the second vessel 24, transfer tank 32, or connecting conduits will be transferred to the condenser. This process will continue until the pressure as sensed by the pressure sensor 123 exceeds the system high limit. At this point, the process will shut off the pump assembly 28 and valves 90, 92 and 94. The condenser fan will continue to run and once the pressure has stabilized, the purge valve 122 will allow accumulated non-condensables to vent from the system until the sensed pressure at a pressure sensor 125 reaches preset limits. (The pressure sensor 125 is preferably the discharge pressure sensor 123 relocated in position).

Once the purge is terminated, valves 90 and 92 are reopened and the pump assembly 28 is restarted in the configuration of FIG. 5. The pressure sensor 123 is monitored and other appropriate configurations may be selected.

Figure 6:
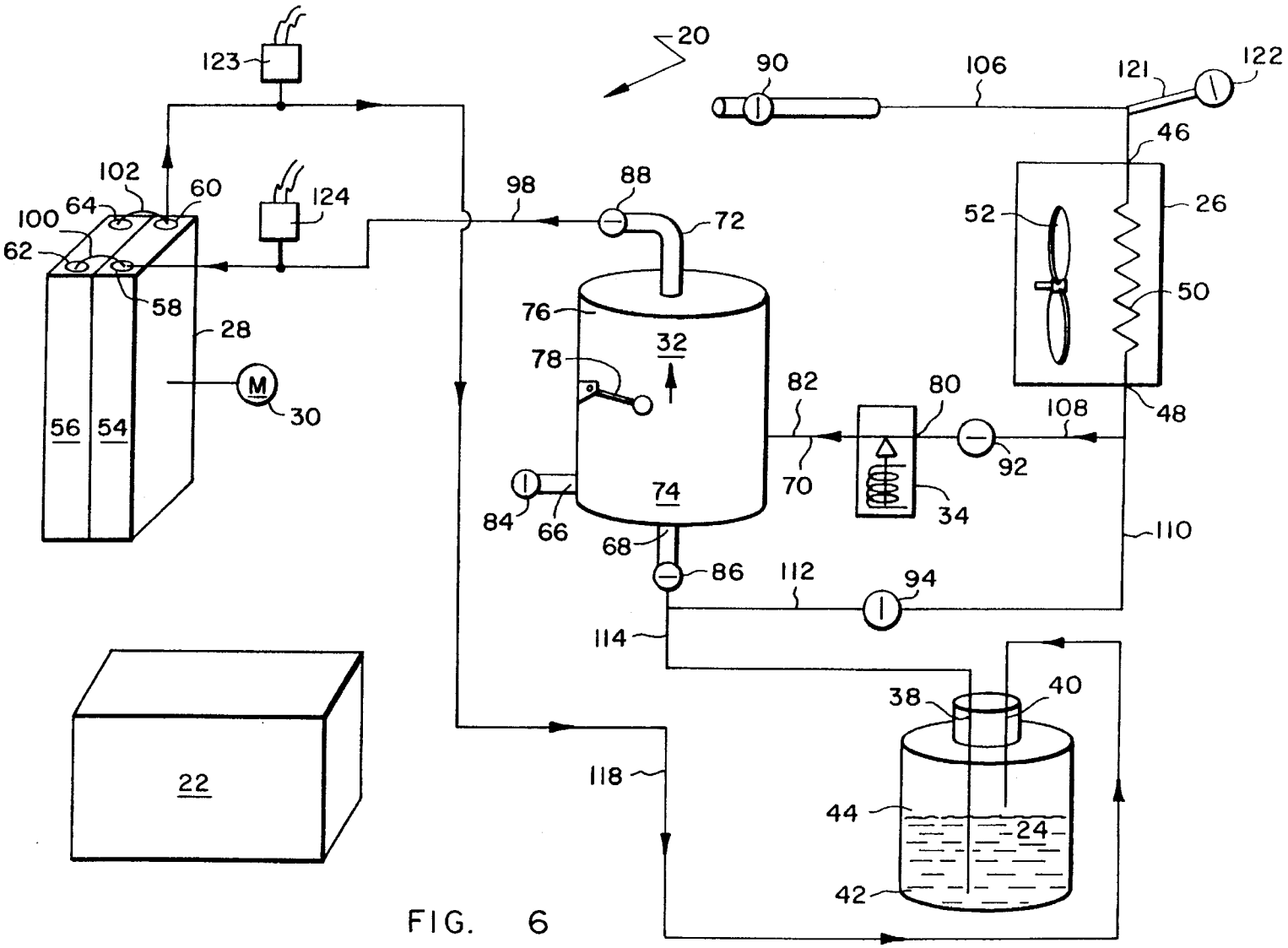
FIG. 6 is a view similar to FIG. 1, showing a sixth mode of operation of the system.

FIG. 6 shows the final step of the process for transferring the refrigerant from the first vessel 22 to the second vessel 24. After the liquid refrigerant is exhausted from the transfer tank 32 in the configuration of FIG. 5, the valves 86 and 90 are closed. The ends of the conduits 118 and 104 connected to the inlet and outlet 58 and 60 are reversed, and the other end of the conduit 104 is shifted from communication with the valve 90 to communication with the valve 88. After these changes, the conduit indicated as 104 in FIG. 5 becomes the conduit indicated as 98 in FIG. 6. Finally, the valve 88 is opened.

In the configuration of FIG. 6, the conduit 106, the condenser coil 50, the conduits 108 and 110, the transfer tank 32, the conduit 98, and the pump assembly 28 itself are evacuated to the extent possible by the pump assembly 28. The pump assembly 28 may be returned to series configuration if a higher vacuum level in the system is desired. The refrigerant vapor extracted from the recovery system is passed via the conduit 118 into the second refrigerant vessel 24. The valve 88 is then shut and the conduits 98, 118, and 114 can be disconnected if desired.

The system 20 described above can be used in reverse to evacuate the refrigerant from the second refrigerant vessel 24 and transfer it back to the first refrigerant vessel 22. In the reverse operation, the vapor port 40 is not necessary, and the vessel 24 can be evacuated through its fluid refrigerant port 38 alone in the same manner as the first refrigerant vessel 22 is evacuated. If the vessel 22 has been substantially evacuated when the refrigerant was removed and does not leak, there also is no need for a vapor port in the vessel 22 to allow it to be refilled with a liquid refrigerant.

In an alternate embodiment of the invention, configuration valves, optionally controlled electronically, can be used to make and break some or all of the conduit connections, particularly for the conduits 98, 100, 102, 104, 118, and 120 which are variously connected in the different configurations. The determination of the necessary connections, the selection and hook-up of configuration valves for making the necessary connections, and the provision of an electronic control system for operating the valves are each well within the capabilities of a person of ordinary skill in the art, with reference to the configurations of FIGS. 1 through 7.

Another alternate embodiment of the invention is contemplated for increasing the level of vacuum which can be attained in the first refrigerant vessel 22. This alternative can be used with the present system, as well as with prior systems in which a single-stage pump is employed. In this alternative embodiment, a supplemental pump or compressor 130 (shown in phantom in FIG. 1) is inserted between the port 36 and the port 66 to increase the pressure of the refrigerant delivered to the port 66. This booster pump allows a higher vacuum to be drawn in the vessel 22 without changing any of the other components of the system. Thus, a refrigerant recovery system adapted to meet existing refrigerant evacuation standards can be upgraded when the evacuation standards become more stringent and require a higher level of vacuum to be drawn in the vessel 22. A pressure regulation bypass can be used to limit the pressure head produced by the booster compressor. The booster compressor can be most advantageously added to the system near the end of the recovery process, when the pressure remaining within the vessel 22 is already low.

A refrigerant recovery unit or similar apparatus has been illustrated which combines the advantages of having a high volume pump and a high pressure pump. When the pumps are arranged in series, the unit can achieve a higher recovery level than other units presently available with comparable pumps. One motor may be used to drive both a high-volume pump and a high-pressure pump. The unit has a nearly constant horsepower requirement in the different stages of a refrigerant transfer operation. The unit can be configured in the several necessary ways by making hose connection changes, by providing permanent conduits and a series of configuration valves, or by a combination of these expedients. Thus, the invention achieves one or more of its objects.

I claim:

1. A method of transferring refrigerant from a first vessel to a second vessel comprising the steps of:

establishing and operating a first system configuration to transfer refrigerant from the first vessel to a transfer tank;

establishing and operating a second system configuration to produce a partial vacuum in the first vessel and thereby transfer refrigerant vapor to the transfer tank including the further step of providing and operating a pair of pumps in series;

establishing and operating a third system configuration to transfer liquid refrigerant from the transfer tank to the second vessel; and providing and operating in the first and third system configurations the pair of pumps arranged in parallel.

2. The method of claim 1 including the further step of establishing and operating a fourth system configuration to condense vapor in the first vessel and to add the condensate therefrom to a liquid reservoir in the transfer tank including providing and operating the pair of pumps independently of each other.

3. A method of transferring refrigerant from a first vessel to a second vessel comprising the steps of:

establishing and operating a first system configuration to transfer refrigerant from the first vessel to a transfer tank;

establishing and operating a second system configuration to produce a partial vacuum in the first vessel and thereby transfer refrigerant vapor to the transfer tank;

establishing and operating a third system configuration to transfer liquid refrigerant from the transfer tank to the second vessel; and establishing and operating a fourth system configuration to condense vapor in the first vessel and to add the condensate therefrom to a liquid reservoir in the transfer tank.

4. The method of claim 3 including the further step of establishing and operating a fifth system configuration to clear the system of recovered liquid and to cool the transfer tank after all vapor has been recovered from the first vessel.

5. The method of claim 4 including the further step of establishing and operating a sixth system configuration wherein the transfer tank is evacuated.

6. The method of claim 5 including the further step of providing a supplemental pump between the first vessel and the transfer tank and thereby draw a higher vacuum in the first vessel.

7. The method of claim 6 wherein the first through sixth configurations are established manually.

8. The method of claim 6 wherein the first through sixth configurations are established automatically.

9. A method of transferring refrigerant from a first vessel to a second vessel comprising the steps of:

establishing and operating a first system configuration to transfer refrigerant from the first vessel to a transfer tank including the further steps of transferring liquid and vaporous refrigerant to the transfer tank and transferring vaporous refrigerant from the transfer tank to the second vessel;

establishing and operating a third system configuration to transfer liquid refrigerant from the transfer tank to the second vessel; and providing and operating in the first and third system configurations a pair of pumps arranged in parallel.

10. A method for transferring a refrigerant between a first refrigerant vessel and a transfer tank, comprising the steps of:

A. providing a first refrigerant vessel having at least one refrigerant port, a transfer tank having at least two fluid refrigerant ports and at least one refrigerant vapor port, a condenser having an inlet and an outlet; a first pump having a first inlet and a first outlet and operable to produce a first pressure difference; a second pump having a second inlet and a second outlet and operable to produce a second pressure difference; and a valve having an inlet and an outlet and adapted to allow a fluid to flow from said inlet to said outlet when the pressure at said valve inlet exceeds the pressure at said valve outlet by more than a predetermined amount which is not greater than said second pressure difference;

B. operatively connecting in series a refrigerant port of said refrigerant vessel, said first inlet, said first outlet, a first fluid port of said transfer tank, a vapor port of said transfer tank, said second inlet, said second outlet, the inlet of said condenser, the outlet of said condenser, the inlet of said valve, the outlet of said valve, and said second fluid port of said transfer tank; and C. operating said first and second pumps; thereby transferring a refrigerant between said first refrigerant vessel and said transfer tank while condensing refrigerant vapor within said transfer tank.

11. The method of claim 10, carried further to transfer the refrigerant from said transfer tank to a second refrigerant vessel, said method further comprising the steps of:

A. providing a second refrigerant vessel having a refrigerant fluid port and a refrigerant vapor port; and B. when said transfer tank contains at least a predetermined amount of liquid, re-configuring said system to remove said first refrigerant vessel from communication with said transfer tank and to place in series said refrigerant vapor port of said second refrigerant vessel, the inlet of at least one of said first and second pumps, the outlet of the same one of said first and second pumps, the vapor port of said transfer tank, a fluid port of said transfer tank, and the fluid port of said second refrigerant vessel; whereby operation of said at least one pump urges refrigerant vapor into said transfer vessel and liquid refrigerant from said transfer vessel to said second refrigerant vessel.

* * * * *